US008452644B2

(12) United States Patent
Povolny

(10) Patent No.: US 8,452,644 B2
(45) Date of Patent: May 28, 2013

(54) RADIO BEACON FOR A WIRELESS ROAD TOLL SYSTEM

(75) Inventor: Robert Povolny, Vienna (AT)

(73) Assignee: Kapsch Trafficcom AG, Vienna (AT)

( * ) Notice: Subject to any disclaimer, the term of this patent is extended or adjusted under 35 U.S.C. 154(b) by 136 days.

(21) Appl. No.: 13/053,082

(22) Filed: Mar. 21, 2011

(65) Prior Publication Data

US 2011/0267470 A1 Nov. 3, 2011

(30) Foreign Application Priority Data

Apr. 29, 2010 (EP) ..... 10450068

(51) Int. Cl.
*G07B 15/00* (2011.01)
*G07B 15/02* (2011.01)

(52) U.S. Cl.
USPC ..... 705/13; 340/902; 340/936

(58) Field of Classification Search
USPC ..... 705/13; 340/936, 989, 902, 531
See application file for complete search history.

(56) References Cited

U.S. PATENT DOCUMENTS

| | | | | |
|---|---|---|---|---|
| 5,955,969 | A | 9/1999 | D'Hont | |
| 2003/0011494 | A1* | 1/2003 | Reider et al. | 340/993 |
| 2003/0067396 | A1* | 4/2003 | Hassett | 340/825.49 |
| 2003/0214585 | A1* | 11/2003 | Bakewell | 348/148 |
| 2006/0017562 | A1* | 1/2006 | Bachelder | 340/531 |
| 2008/0002031 | A1* | 1/2008 | Cana et al. | 348/208.14 |
| 2008/0036623 | A1* | 2/2008 | Rosen | 340/936 |
| 2008/0136908 | A1* | 6/2008 | Carter | 348/143 |
| 2009/0024458 | A1* | 1/2009 | Palmer | 705/13 |
| 2009/0146845 | A1* | 6/2009 | Hedley | 340/936 |
| 2009/0157566 | A1 | 6/2009 | Grush | |
| 2009/0174572 | A1* | 7/2009 | Smith | 340/902 |
| 2009/0184847 | A1* | 7/2009 | Kohli et al. | 340/989 |
| 2010/0198665 | A1* | 8/2010 | Daems et al. | 705/13 |
| 2010/0201829 | A1* | 8/2010 | Skoskiewicz et al. | 348/211.2 |
| 2010/0287038 | A1* | 11/2010 | Copejans | 705/13 |

FOREIGN PATENT DOCUMENTS

EP 0 616 302 A2 2/1994

OTHER PUBLICATIONS

"Intelligent Transportation Systems Standards Fact Sheet," published by the U.S. Department of Transportation onf Sep. 25, 2009, pp. 1-3 of 3.*

Extended European Search Report for corresponding European Patent Application No. 10 450 068.1, dated Sep. 2, 2010, 5pp.

* cited by examiner

*Primary Examiner* — Brian Epstein

(74) *Attorney, Agent, or Firm* — Christie, Parker & Hale, LLP

(57) ABSTRACT

A radio beacon for a wireless road toll system including a transceiver, which is arranged for packet-type radio communication with onboard units of passing vehicles; at least one camera for recording an image of a passing object; and a control device connecting to the transceiver and the camera. The control device is configured to measure, in conjunction with the transceiver, the number of data packets received per unit time from a specific onboard unit and to actuate the camera to record an image of the object carrying this onboard unit, in the case of a number exceeding a threshold value.

6 Claims, 1 Drawing Sheet

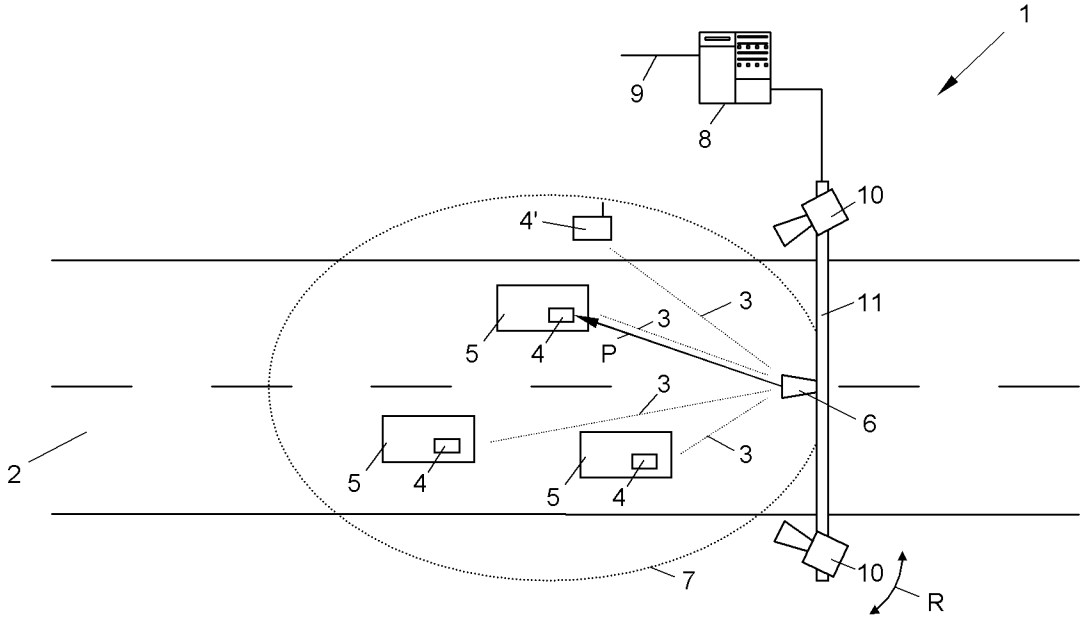
1
2
3
4
4'
5
6
7
8
9
10
11
P
R

RADIO BEACON FOR A WIRELESS ROAD TOLL SYSTEM

CROSS-REFERENCE TO RELATED APPLICATION(S)

This application claims priority to European Patent Application No. 10 450 068.1, filed on Apr. 29, 2010, the contents of which are hereby expressly incorporated by reference.

FIELD OF THE INVENTION

The present invention relates to a radio beacon for a wireless road toll system comprising a transceiver, which is arranged for packet-type radio communication with onboard units of passing vehicles, at least one camera for recording an image of a passing object and a control device connecting to the transceiver and the camera.

BACKGROUND

The increasing opening up of wireless road toll systems of proprietary specifications to interoperable standards such as DSRC (dedicated short-range communication), WAVE (wireless access in a vehicle environment) or WLAN (wireless local area networks) brings with it the risk of interference in the radio communication by malfunctioning onboard units (OBUs) of third-party manufacturers or intentional flooding of the radio channel by "content jamming" or "denial of service" attacks.

SUMMARY

In some embodiments, the present invention is a radio beacon for a wireless road toll system. A control device is configured to measure the number of data packets received per unit time from a specific onboard unit, in conjunction with a transceiver. In the case of the number of data packets exceeding a threshold value, the invention actuates a camera to record an image of the object carrying the onboard unit. In this way, OBUs that interfere in the radio communication by content jamming, denial of service attacks or the like in the surrounding area of the radio beacon can automatically be recognised and the toll enforced on the basis of the recorded image of the object carrying it, e.g. the vehicle.

In some embodiments, the transceiver is capable of measuring the location of the onboard unit by means of radio positioning during the course of the radio communication and of indicating the location to the control device. The control device stores the location jointly with the recorded image and transmits it to a central unit of the road toll system. As a result, in the case of multiple vehicles in the radio coverage area or in the image, a precise local match of the image area to the interfering OBUs can also be made.

In some embodiments, the recording direction of the camera is controllable by the control device controls based on the indicated location. If multiple cameras are provided, the control device actuates a respective camera to record an image based on the indicated location. In some embodiments, the control device can also carry out an automatic number plate recognition operation on a vehicle number plate contained in the camera image.

BRIEF DESCRIPTION OF THE DRAWINGS

FIG. 1 is an exemplary block diagram in plan view onto a section of a road toll system with a radio beacon, according to some embodiments of the invention.

DETAILED DESCRIPTION

FIG. 1 shows a radio beacon 1 of a road toll system (not further shown) by way of example. The radio beacon 1 is arranged on a road 2 to conduct radio communications 3 with onboard units (OBUs) 4 of passing vehicles 5. Moreover, the radio beacon 1 includes a short-range transceiver 6 with a radio coverage area 7.

The radio beacon according to the invention is suitable for road toll systems operating according to every wireless radio standard known in the art. It is particularly suitable for road toll systems, in which the radio communication is conducted in accordance with the WAVE standard. WAVE communications are particularly prone to interference by WLAN terminals in the radio coverage area.

The radio communications 3 are packet-type radio communications, i.e. with a sequence of data packets that are exchanged between the transceiver 6 and the OBUs 4, for example, in accordance with the DSRC, WAVE or WLAN standard, as known to the person skilled in the art.

The transceiver 6 connects with a control device 8 of the radio beacon 1, which generates toll transactions relating to the vehicles 5 passing the radio beacon 1 from the radio communications 3 in order to charge for usage of the road 2 by the vehicles 5, for example. The toll transactions can be transmitted via a data connection 9 from the radio beacon 1 to a central unit (not shown) of the road toll system.

In some embodiments, the radio beacon 1 is equipped with one or more cameras 10, which are mounted, for example, jointly with the transceiver 6 on a support 11 spanning the road 2. The camera(s) 10 connect to the control device 8, can be actuated by this and transmit their images to this.

As part of the radio communications 3, the transceiver 6 measures the number of data packets transmitted by a specific OBU 4 per unit time (rate) and compares this number with a preset maximum threshold value in order to detect a packet density of the data packets transmitted by an OBU 4 that is too high in relation to time. In the case of such a threshold being exceeded, the control device 8 causes the camera 10 to record an image of the surrounding area of the radio beacon 1 and/or the section of road 2 and/or the radio coverage area 7 and/or at least precisely the area in which this radio communication 3 is conducted, in order to actuate an image of the vehicle 5 or other object carrying this OBU 4.

In some embodiments, if the "interfering" OBU 4 is carried by a vehicle, the recorded image contains the number plate of the vehicle 5. Therefore, the number plate can be recognised automatically by means of a character reading technique (optical character recognition, OCR).

In some embodiments, the transceiver 6 is a radio-positioning transceiver capable of determining the precise location P of the interfering OBU 4 in the radio coverage area 7, for example, by radio triangulation. As a result, the control device at 8 can select, for example, the camera 10 in whose viewing field the determined location P falls and cause it to record an image. Alternatively or additionally hereto, the cameras 10 can also be controllable in their recording direction R, e.g. RTZ cameras (rotate-tilt-zoom), as a result of which the control device 8 can also align to the determined location P of the interfering OBU 4. Moreover, an OBU-ID of the interfering OBU 4 transmitted along with the data packets as part of the radio communication 3 can also be displayed by the control device 8.

In some embodiments, the image recorded by the camera, the optionally available OBU-ID, the optional determined location P of the OBU 4 and the date of the recorded image are stored in the control device 8 and/or transmitted via the data line 9 to the central unit of the road toll system.

It is understood that an interfering OBU 4 does not necessarily have to be carried by a vehicle 5 as vehicle OBU, but can be carried, for example, in another form by any object, e.g. as WLAN or WAVE terminal 4', which is carried by a user, for example, in the form of a portable computer, PDA (personal digital assistant), mobile telephone or the like. Therefore, in the present description all such devices 4 and 4' are covered by the term "OBU" 4 used here. Consequently, the invention is not restricted to the represented embodiments, but covers all variants and modifications that fall within the framework of the attached claims.

It will be recognized by those skilled in the art that various modifications may be made to the illustrated and other embodiments of the invention described above, without departing from the broad inventive scope thereof. It will be understood therefore that the invention is not limited to the particular embodiments or arrangements disclosed, but is rather intended to cover any changes, adaptations or modifications which are within the scope and spirit of the invention as defined by the appended claims.

What is claimed is:

1. A radio beacon for a wireless road toll system comprising:

a transceiver configured for packet-type radio communication with onboard units of passing objects;

at least one camera for recording an image of a passing object; and a control device electrically coupled to the transceiver and the camera, wherein the control device is configured to measure, in conjunction with the transceiver, the rate of data packets received from an onboard unit and in the case of the rate exceeding a threshold value, to actuate the camera to record an image of the object carrying said onboard unit.

2. The radio beacon according to claim 1, wherein the transceiver is capable of measuring a location of said onboard unit by radio positioning during a course of said radio communication, and indicating said location to the control device, and wherein the control device is configured to store said location jointly with the recorded image and/or transmit said location to a central unit of the road toll system.

3. The radio beacon according to claim 2, wherein the recording direction of the camera is controlled by the control device according to the indicated location.

4. The radio beacon according to claim 3, further comprising a plurality of cameras, wherein the control device actuates a respective camera of the plurality of cameras to record an image based on the indicated location.

5. The radio beacon according to claim 1, wherein the control device is configured to carry out an automatic number plate recognition operation on a vehicle number plate contained in the camera image.

6. The radio beacon according to claim 1, wherein the radio communication is conducted in accordance with wireless access in a vehicle environment (WAVE) standard.

* * * * *